US005180908A

United States Patent [19]

Suyama

[11] Patent Number: 5,180,908

[45] Date of Patent: Jan. 19, 1993

[54] DEVICE FOR DERIVING A CHANGE OF TIME-DEPENDENT INFORMATION BY CONVERTING THE INFORMATION TO POSITIONAL-DEPENDENT INFORMATION

[75] Inventor: Motohiro Suyama, Hamamatsu, Japan

[73] Assignee: Hamamatsu Photonics K.K., Shizuoka, Japan

[21] Appl. No.: 759,292

[22] Filed: Sep. 13, 1991

[30] Foreign Application Priority Data

Sep. 14, 1990 [JP] Japan ..... 2-245230

[51] Int. Cl.[5] ..... H01J 31/50

[52] U.S. Cl. ..... 250/214 VT; 313/529

[58] Field of Search ..... 250/213 VT, 492.1, 492.24; 313/529, 537

[56] References Cited

U.S. PATENT DOCUMENTS

| | | | |
|---|---|---|---|
| 4,891,581 | 1/1990 | Takiguchi | 250/213 VT |
| 4,942,293 | 7/1990 | Koishi et al. | 250/213 VT |
| 4,956,548 | 9/1990 | Alfano et al. | 250/213 VT |
| 4,958,231 | 9/1990 | Tsuchiya | 250/213 VT |
| 5,101,100 | 3/1992 | Kinoshita et al. | 250/213 VT |

FOREIGN PATENT DOCUMENTS

| | | |
|---|---|---|
| 0187087 | 7/1986 | European Pat. Off. . |
| 0424148 | 11/1991 | European Pat. Off. . |
| 821070 | 11/1951 | Fed. Rep. of Germany . |
| 2164201 | 5/1984 | United Kingdom . |

*Primary Examiner*—David C. Nelms
*Assistant Examiner*—John R. Lee
*Attorney, Agent, or Firm*—Sughrue, Mion, Zinn, Macpeak & Seas

[57] ABSTRACT

Time-dependent information such as light whose intensity varies with time is converted into positional information representing the change of the time-dependent information. A series of photoelectrons provided as the time-dependent information are accelerated or decelerated when passing through a region defined by first and second electrode to which a ramp voltage is applied so that the photoelectrons are accelerated or decelerated and are released at speeds varying depending on times. A speed analyzer analyzes the speeds of the photoelectrons and provides the positional information. The positional information is applied to a phosphor screen on which the positions of the photoelectrons applied thereto are displayed. The positions thereof represents the times involved with the photoelectrons.

19 Claims, 3 Drawing Sheets

DEVICE FOR DERIVING A CHANGE OF TIME-DEPENDENT INFORMATION BY CONVERTING THE INFORMATION TO POSITIONAL-DEPENDENT INFORMATION

BACKGROUND OF THE INVENTION

1. Field of the Invention

The present invention relates generally to a device for deriving a change of time-dependent information. More particularly, the invention relates to such a device in which time-dependent intensity information or time-dependent quantity information of charged particles such as electrons, ions or the like are converted to positional information spatially representing the times involved with the time-dependent information. The present invention further relates to a device for measuring and displaying a light intensity waveform of light whose intensity varies dependent on time.

2. Description of the Prior Art

There have been know some devices for measuring time-dependent changes in charged particles in a vacuum, i.e., time-dependent changes in the number of charged particles, using an electron multiplier. More specifically, the charged particles to be measured are introduced into an electron multiplier and the number of electrons is increased by producing secondary electrons that are liberated upon collision of the charged particles. The electrons are received by an anode and measured by an oscilloscope. According to another arrangement, the charged particles to be measured are caused to impinge on a scintillator and converted thereby into light, which is then detected as an electric signal with a photomultiplier tube (PMT) or the like. The detected electric signal is measured by an oscilloscope.

In either of the above conventional devices, a change in the intensity of the charged particles is merely amplified and detected as an electric signal to be measured with an oscilloscope, without affecting any special conversion process with respect to time. Therefore, intensity changes that can be measured are limited by the response speed of the oscilloscope used. It is impossible at present to measure time-dependent intensity changes less than 30 ps. Even to maintain a response speed of about 30 ps, care should be taken to design the layout of signal lines and select circuit components. It is therefore not, easy to measure time-dependent intensity changes less than 30 ps.

There has been proposed an arrangement based on the principles of a streak tube for a higher response speed, as shown in FIG. 1 of the accompanying drawings. In FIG. 1, two deflection plates 2, 3 are disposed in a path 1 of the charged particles (photoelectrons) to be measured, and a ramp voltage synchronous with the introduced electrons is applied between the deflection plates 2, 3 to convert a time-dependent change in the intensity of the photoelectrons into positional information on an input surface of a microchannel plate 4. The positional information can be visually recognized as light intensities on a phosphor surface 5. The proposed arrangement is effective to increase the response speed greatly compared with the conventional devices.

SUMMARY OF THE INVENTION

The present invention has been made to provide a new and novel arrangement for deriving a change of time-dependent information.

According to one aspect of the present invention, there is provided a device for deriving a change of time-dependent information represented by a series of charged particles, which comprises a source for emitting the charged particles; accelerating (or decelerating) means for accelerating (or decelerating) the charged particles emitted from the source and releasing the charged particles at speeds varying dependent on time; and analyzing means for analyzing the speeds of the released charged particles and providing output information varying dependent on the speeds of the charged particles, the output information representing the change of the time-dependent information.

The device may further comprise a first voltage source for supplying a voltage varying with time, wherein the accelerating means comprises first and second electrodes disposed in confronting relation to each other, a time-dependent intensity variable electric field being developed between the first and second electrodes in accordance with the voltage from the first voltage source.

The analyzing means comprises an output screen such as a phosphor screen on which the output information is applied, the output screen displaying the positions of the charged particles, the positions thereof representing the times involved with the charged particles.

Since the electric field developed between the first and second electrodes varies with time, the charged particles are given different amounts of energy or speeds dependent on the time at which they are emitted from the charged particle emitting source. Consequently, upon performing an analysis of the energy or speeds of the charged particles with the analyzing means, the change of the time-dependent information can be obtained.

According to another aspect of the present invention, there is provided a device for measuring an intensity waveform of light whose intensity varies dependent on time, which comprises photoelectric converting means having a surface for emitting a series of photoelectrons depending on the intensity of the light applied thereto; accelerating (or decelerating) means disposed in confronting relation to the surface of the photoelectric converting means for accelerating (or decelerating) the photoelectrons emitted from the surface of the photoelectric converting means and releasing the photoelectrons at speeds varying dependent on time; and analyzing means for analyzing the speeds of the released photoelectrons and providing output information varying dependent on the speeds of the photoelectrons, the output information representing the intensity of light varying dependent on time.

The device may further comprise computing means for computing the output information and outputting information regarding the light intensity waveform of the light, and displaying means for displaying the intensity waveform of the light based on the information supplied from the computing means.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENTS

Figure 2A:
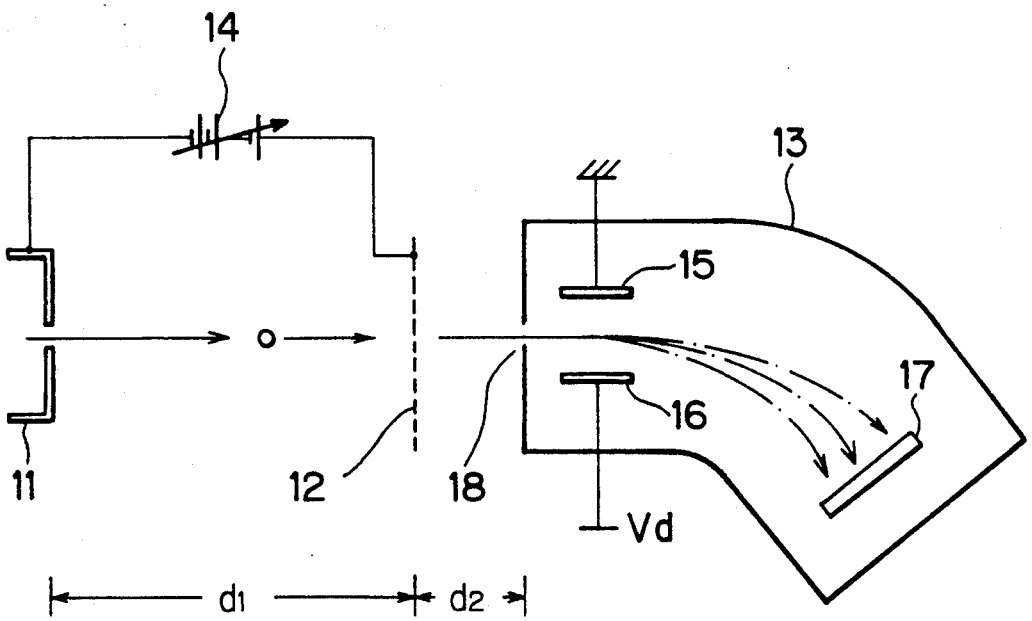
FIG. 2A is a sectional side elevational view schematically showing a structure of a charged particle measuring device according to an embodiment of the present invention.

A first embodiment of the present invention will now be described with reference to FIG. 2A where there is shown an arrangement of a charged particle measuring device. The measuring device includes a source 11 for emitting the charged particles, a mesh-like accelerating electrode 12, and a unit 13 serving generally as an energy analyzer and specifically as a speed analyzer. Both the electrode 12 and the unit 13 are successively disposed in front of the source 11. A voltage that varies with time is applied between the accelerating electrode 12 and the source 11 by a power supply 14. The potential of one of the source 11 and the accelerating electrode 12 is fixed, whereas the potential of the remainder of the varies device with time.

The energy or speed analyzer 13 includes two deflection plates 15, 16 arranged in parallel to each other with a space therebetween, and an output screen 17 such as a phosphor screen which emits light in response to the charged particles impinged thereon. The analyzer 13 is disposed in an orientation to receive the charged particles through an aperture formed on one face of an enclosure of the analyzer 13. A constant voltage is applied between the deflection plates 15, 16 to develop an electrostatic field in the space therebetween. Charged particles which enter from the aperture 18 pass through the electrostatic field, and are deflected thereby before reaching the output screen 17.

In operation, since the voltage applied to the accelerating electrode 12 varies with time, the intensity of the electric field developed between the source 11 and the accelerating electrode 12 varies in timed relation with the voltage applied to the accelerating electrode 12. Consequently, the charged particles emitted from the source 11 at different times are given different amounts of energy by the electric field, and reach the analyzer 13 at different speeds.

An amount by which the charged particle is deflected when passing through the electrostatic field between the deflection plates 15, 16, varies depending on the speed or energy of the charged particle. Therefore, the charged particles that have been emitted from the source 11 at different times reach different positions on the output screen 17. Stated differently, the time-dependent information of the charged particles is converted into positional information on the output screen 17.

High-speed changes in the electric field between the source 11 and the accelerating electrode 12 are produced by the power supply 14 which applies a voltage that varies at high speed. According to the recent technology, it is possible to produce a change of 3 kV/200 picoseconds (ps) in the electric field, and hence a voltage change of 0.15 V in 10 femtoseconds (fs). The analyzer 13, on the other hand, has a resolution of 0.1 eV or less. Consequently, less than 10 fs response speed can be achieved by the device of the present invention.

Figure 1:
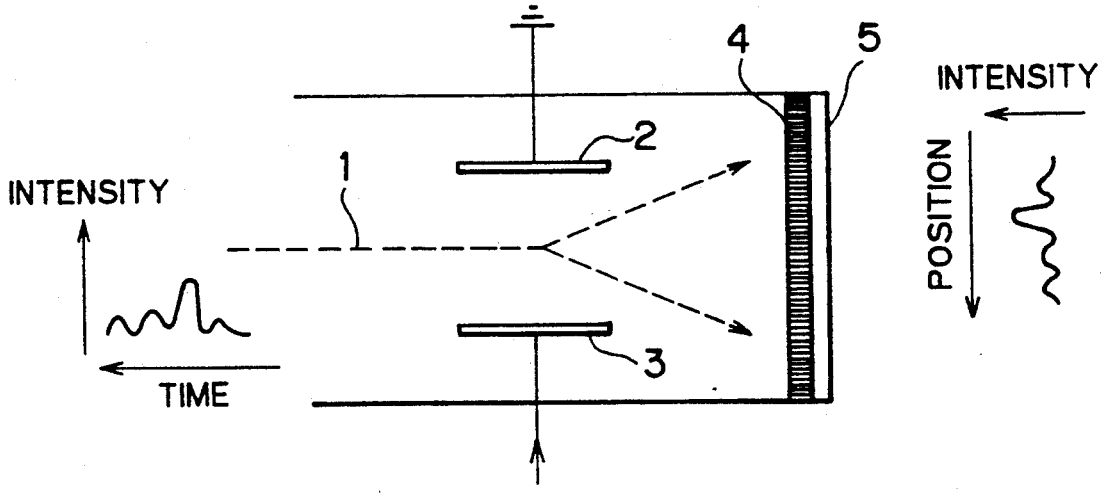
FIG. 1 PRIOR ART
FIG. 1 is a sectional side elevational view schematically showing a structure of a conventional charged particle measuring device.
Figure 3:
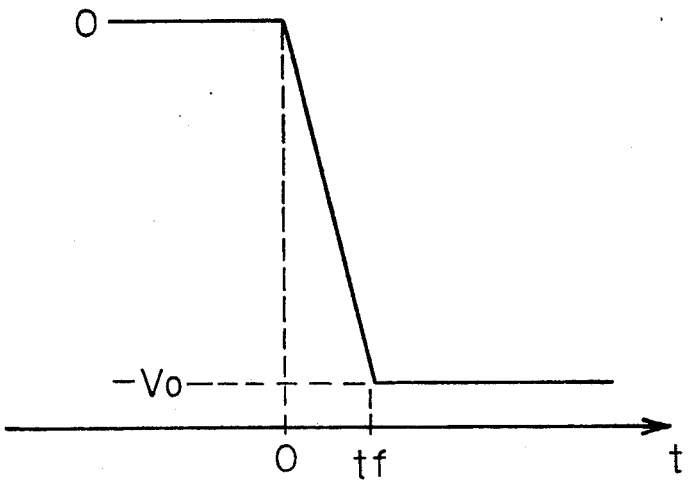
FIG. 3 is a diagram showing the waveform of an accelerating voltage applied between a charged particle source and an accelerating electrode.

Operation of the present embodiment will be described in more detail while using equations. It is assumed that the charged particle source 11 and the accelerating electrode 12 are spaced from each other by a distance $d_1$ (zone 1), and the accelerating electrode 12 and the aperture 18 of the analyzer 13 are spaced from each other by a distance $d_2$ (zone 2). A constant voltage of $-V_0$ is applied to the source 11, and a ramp voltage is applied to the accelerating electrode 12. The ramp voltage has a waveform such that it varies linearly from 0 volt at a time of $t=0$ to a voltage of $-V_0$ volt at a time $t=t_f$ as shown in FIG. 3. The equation of motion of a charged particle that is emitted at the time $t=t_0$ is given as follows.

For the zone 1, $$\frac{d^2z}{dt^2} = \frac{-Q}{M} \cdot \frac{-V_0 - V(t + t_0)}{d_1} \tag{1}$$

For the zone 2

$$\frac{d^2z}{dt^2} = \frac{-Q}{M} \cdot \frac{V(t + t_0 + t_{d1})}{d_2} \tag{2}$$

$$V(t) = -V_0 \cdot \frac{t}{t_f}$$

where M is the mass of a charged particle, $-Q$ is the electric charge of a charged particle, $t_{d1}$ is the time at which the charged particle reaches the accelerating electrode 12.

Integrating equations (1) and (2), the speed v and the position z of the charged particle are obtained.

For the zone 1, $$v = \frac{dz}{dt} = \frac{QV_0}{Md_1t_f}\left\{(t_f - t_0)t - \frac{1}{2}t^2\right\} \tag{3}$$

$$z = \frac{QV_0}{Md_1t_f}\left\{\left(\frac{1}{2}(t_f - t_0)t^2 - \frac{1}{6}t^3\right\}\right. \tag{4}$$

For the zone 2, $$v = \frac{QV_0}{Md_2t_f} \cdot \left\{(t_0 + t_{d1})t + \frac{1}{2}t^2\right\} + V_d \tag{5}$$

$$z = \frac{QV_0}{Md_2t_f} \cdot \left\{\frac{1}{2}(t_0 + t_d)t^2 + \frac{1}{6}t^3\right\} + v_dt + d_1 \tag{6}$$

where $V_d$ is the speed in the position $z=d_1$. Note that the potential at the face of the analyzer enclosure on which the aperture 18 is formed is maintained at 0 volt.

For the sake of brevity, it is assumed that the charged particles are electrons, and the parameters are selected as follows:

$d_1 = 2$ mm,
$d_2 = 0.5$ mm,
$V_0 = 3$ kV, and
$t_f = 200$ ps, and the electrons emitted successively at the times $t_0 = 1$ps, $t_0 = 2$ ps, and $t_0 = 3$ ps are applied to the analyzer 13 with the following respective amounts of energy:

| $t_0$(ps) | Energy (eV) |
|---|---|
| 1 | 3894 |
| 2 | 3899 |
| 3 | 3903 |

If these electrons enter between the deflection plates 12, 13 that have a length of l and are spaced from each other by a distance $d_3$, and a deflection voltage $V_d$ is applied between the deflection plates 15, 16, then the amounts Y by which the electrons are deflected on the output screen 17 that is spaced from the deflection plates 15, 16 by a distance of L are given as follows:

$$Y = \frac{lV_d}{2d_3V}\left(\frac{l}{2} + L\right) \quad (7)$$

where V is the energy with which the electrons are applied.

If $l = 25$ mm, $d_3 = 5$ mm, $L = 100$ mm, and $V_d = 1500$ volts, then the amounts by which the three electrons that have been emitted at different times are deflected are as follows:

| $t_0$(ps) | Y (mm) |
|---|---|
| 1 | 108.3 |
| 2 | 108.2 |
| 3 | 108.1 |

Therefore, the time-dependent information of the charged particles are converted into positional information on the output screen 17. The time-dependent information of the charged particles can be accessed from the distribution of brightness on the output screen 17.

While the accelerating electrode 12 and the analyzer 13 are separate from each other in the above embodiment, the entrance face of the analyzer enclosure may double as an accelerating electrode.

In the above embodiment, the power supply 14 serving as a means for applying a variable voltage is connected between the accelerating electrode 12 and the charged particle source 11, and these components jointly serve as an accelerating means for applying an accelerating energy which varies with time. However, the charged particle source 11 may be separate from the accelerating means.

Figure 2B:
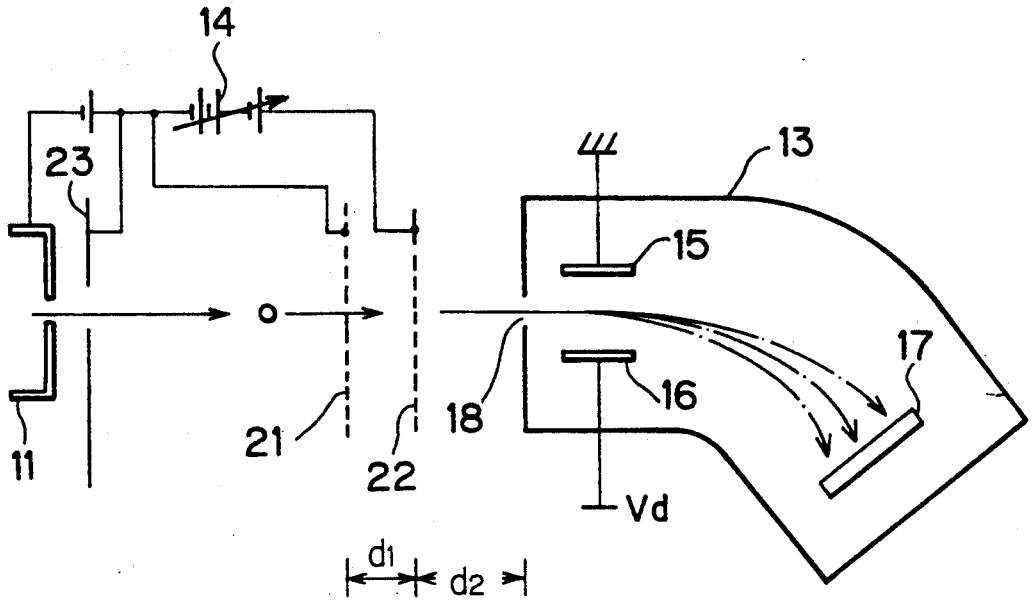
FIG. 2B is a sectional side elevational view showing a modification of the structure shown in FIG. 2A.

FIG. 2B shows such a modification in which the accelerating means for applying a variable accelerating energy includes accelerating electrodes 21, 22 and the variable voltage power supply 14. A constant voltage is applied to an accelerating electrode 23 with respect to the voltage at the source 11 for imparting a constant accelerating energy to the charged particles emitted from the source 11.

Figure 4:
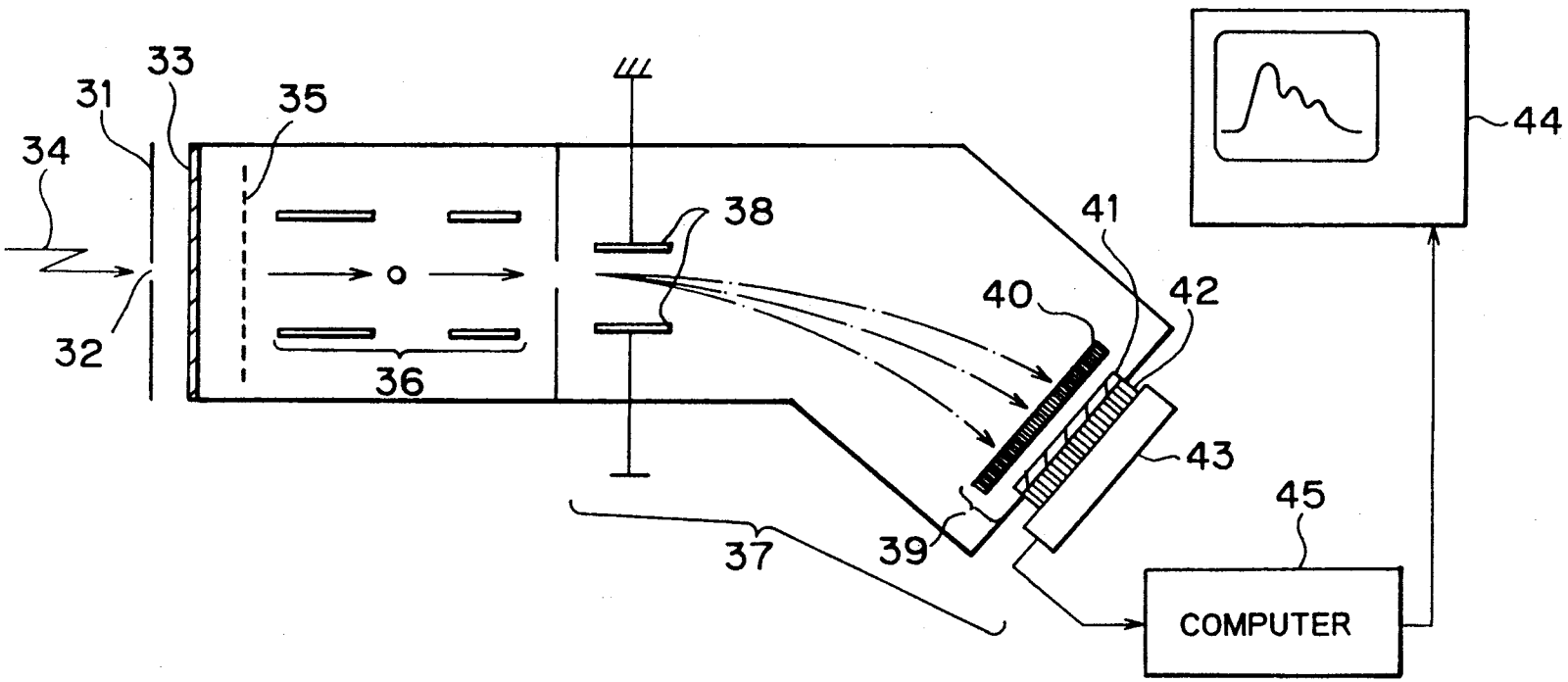
FIG. 4 is a sectional side elevational view schematically showing a structure of a light intensity waveform measuring device according to an embodiment of the present invention.

FIG. 4 shows a second embodiment of the present invention. Shown in FIG. 4 is a light intensity waveform measuring device incorporating therein the time-dependent change measuring device of the present invention. The light intensity waveform measuring device employs a photoelectric transducer means as the charged particle source, and serves to measure the waveform of a time-dependent intensity of light that falls on the photoelectric transducer means.

When light 34 to be measured is applied to a photocathode 33, which serves as the photoelectric transducer means, through an aperture 32 in an input window 31, the photocathode 33 emits photoelectrons depending on the intensity of the light applied. When a ramp voltage is applied between the photocathode 33 and the accelerating electrode 35, the photoelectrons emitted from the photocathode 33 are subjected to speed modulation, and pass through an accelerating electrode 35. The electrons then pass through a focusing electrode assembly 36. Time-dependent information of the photoelectrons, i.e., the waveform of a time-dependent intensity of the applied light, is converted into positional information by a speed analyzer 37. The analyzer 37 includes a pair of deflecting plates 38 between which a constant voltage is applied, and an output screen 39.

The focusing electrode assembly 36 serves to converge the photoelectrons onto the output screen 39 through adjustment of a voltage applied thereto. During operation, the voltage applied to the focusing electrode assembly 36 remains constant and hence unchanged, so that the modulated velocities of the photoelectrons are not disturbed by the electric field developed by the focusing electrode assembly 36.

The output screen 39 is made up of a microchannel plate (MCP) 40 and a phosphor screen 41. The phosphor screen 41 is optically coupled to a CCD (charge coupled device) image sensor 43 through optical fibers 42. Accordingly, light emitted from the phosphor screen 41 can electrically be read as image information which bears intensity information on a pixel basis by the CCD image sensor 43. The image information represents the waveform of the time-dependent intensity of the applied light, and may be processed by a computer 45 for displaying it on a display monitor 44.

The speed analyzer 37 has a response speed of 25 fs if its energy resolution is 0.5 eV. While it is possible to employ an analyzer having a higher resolution, the time resolution of the light intensity waveform measuring device is limited to the above value because the distribution of initial-speed energies possessed by photoelectrons when they are emitted from the photocathode 33 is about 0.5 eV with respect to a wavelength 500 nm of applied light.

In the above embodiment, the photocathode 33 is used as one of the electrodes of the accelerating means which applies a variable accelerating energy. However, as with the embodiments shown in FIGS. 2A and 2B, the photocathode 33 may be separate from the accelerating means by adding a new electrode.

In all the above-described embodiments, the accelerating voltage may vary such that it decreases with time rather than increasing with time.

The illustrated analyzers employ parallel flat deflection plates. However, a cylindrical energy analyzer, a concentric hemispherical energy analyzer or the like which finds usual use may also be employed. Furthermore, the illustrated deflecting means for developing an electric field in the analyzer may be replaced with a deflecting means for developing a magnetic field.

The charged particle measuring device according to the present invention can produce time-dependent information of charged particles at a response speed of several tens of femtosecond by modulating the speed of the charged particles with an electric field. The light intensity waveform measuring device which incorporates the charged particle measuring device with a photoelectric transducer means serving as its charged particle source is capable of measuring time-dependent changes in the intensity of light also at a very high response speed of several tens of femtoseconds.

While exemplary embodiments of this invention have been described in detail, those skilled in the art will recognize that there are many possible modifications and variations which may be made in those exemplary embodiments while yet retaining many of the novel features of the invention. For example, in lieu of the accelerating means disposed next to the charged particle emitting source or photoelectric converting means, decelerating means may be disposed for decelerating the charged particles or photoelectrons. All such modifications and variations are intended to be included within the scope of the appended claims.

What is claimed is:

1. A device for deriving a change of time-dependent information represented by a series of charged particles, comprising:

a source for emitting the charged particles;

accelerating means for accelerating the charged particles emitted from said source and releasing the charged particles at varying speeds dependent on times of emission; and analyzing means for analyzing the speeds of the released charged particles and providing output information varying in accordance with the speeds of the charged particles, the output information representing the change of the time-dependent information.

2. The device according to claim 1, further comprising a first voltage source for supplying a voltage varying with time, and wherein said accelerating means comprises first and second electrodes disposed in confronting relation to each other, a time-dependent intensity variable electric field being developed between said first and second electrodes in accordance with the voltage from said first voltage source.

3. The device according to claim 1, wherein said analyzing means comprises an output screen on which the output information is applied, said output screen displaying the positions of the charged particles, the positions thereof representing the time variation of the charged particles.

4. The device according to claim 3, wherein said output screen is a phosphor screen.

5. The device according to claim 2, wherein said source for emitting the charged particles is said first electrode.

6. The device according to claim 2, wherein said analyzing means comprises deflecting means for deflecting the charged particles in a direction perpendicular to a direction in which the charged particles advance.

7. The device according to claim 6, wherein said analyzing means further comprises a second voltage source for applying a constant voltage to said deflecting means to develop an electrostatic field, said deflecting means imparting a force on the charged particles to deflect the particles in the direction perpendicular to the direction in which the charged particles advance, the force being determined by the electrostatic field.

8. The device according to claim 6, wherein said deflecting means imparts a force on the charged particles to deflect the particles in the direction perpendicular to the direction in which the charged particles advance, the force being determined by a magnetic field.

9. A device for measuring an intensity waveform of light whose intensity varies dependent on time, comprising:

photoelectric converting means having a surface for emitting a series of photoelectrons depending on the intensity of the light applied thereto;

accelerating means disposed in confronting relation to the surface of said photoelectric converting means for accelerating the photoelectrons emitted from the surface of said photoelectric converting means and releasing the photoelectrons at varying speeds dependent on times of emission; and analyzing means for analyzing the speeds of the released photoelectrons and providing output information varying in accordance with the speeds of the photoelectrons, the output information representing the intensity of light varying dependent on time.

10. The device according to claim 9, further comprising a first voltage source for supplying a voltage varying with time, and wherein said accelerating means comprises first and second electrodes disposed in confronting relation to each other, a time-dependent intensity variable electric field being developed between said first and second electrodes in accordance with the voltage from said first voltage source.

11. The device according to claim 9, wherein said analyzing means comprises an output screen on which the output information is applied, said output screen displaying the positions of the photoelectrons, the positions thereof representing the times involved with the photoelectrons.

12. The device according to claim 11, wherein said output screen is a phosphor screen.

13. The device according to claim 9, further comprising computing means for computing the output information and outputting information regarding the light intensity waveform of the light, and displaying means for displaying the intensity waveform of the light based on the information supplied from said computing means.

14. The device according to claim 10, wherein said source for emitting the photoelectrons is said first electrode.

15. The device according to claim 11, wherein said analyzing means comprises deflecting means for deflecting the photoelectrons in a direction perpendicular to a direction in which the photoelectrons advance.

16. The device according to claim 15, wherein said analyzing means further comprises a second voltage source for applying a constant voltage to said deflecting means to develop an electrostatic field, said deflecting means imparting a force on the photoelectrons to deflect the photoelectrons in the direction perpendicular to the direction in which the photoelectrons advance, the force being determined by the electrostatic field.

17. The device according to claim 15, wherein said deflecting means imparts a force on the photoelectrons to deflect the photoelectrons in the direction perpendicular to the direction in which the photoelectrons advance, the force being determined by a magnetic field.

18. A device for deriving a change of time-dependent information represented by a series of charged particles, comprising:

a source for emitting the charged particles;

decelerating means for decelerating the charged particles emitted from said source and releasing the charged particles at varying speeds dependent on times of emission; and analyzing means for analyzing the speeds of the released charged particles and providing output information varying in accordance with the speeds of the charged particles, the output information representing the change of the time-dependent information.

19. A device for measuring an intensity waveform of light whose intensity varies dependent on time, comprising:

photoelectric converting means having a surface for emitting a series of photoelectrons depending on the intensity of the light applied thereto;

decelerating means disposed in confronting relation to the surface of said photoelectric converting means for decelerating the photoelectrons emitted from the surface of said photoelectric converting means and releasing the photoelectrons at varying speeds dependent on times of emission; and analyzing means for analyzing the speeds of the released photoelectrons and providing output information varying in accordance with the speeds of the photoelectrons, the output information representing the intensity of light varying dependent on time.

* * * * *